US011717076B1

(12) United States Patent
Franz et al.

(10) Patent No.: US 11,717,076 B1
(45) Date of Patent: Aug. 8, 2023

(54) STRAP ASSEMBLY FOR A WEARABLE MOBILE DEVICE AND METHOD OF USING THE SAME

(71) Applicant: Hand Held Products, Inc., Charlotte, NC (US)

(72) Inventors: Dwight Franz, Mount Laurel, NJ (US); Blake E Dunbar, Mount Laurel, NJ (US); Emily N Cort, Mount Laurel, NJ (US); Robert M Pierce, Mount Laurel, NJ (US)

(73) Assignee: HAND HELD PRODUCTS, INC., Charlotte, NC (US)

( * ) Notice: Subject to any disclaimer, the term of this patent is extended or adjusted under 35 U.S.C. 154(b) by 0 days.

(21) Appl. No.: 17/660,792

(22) Filed: Apr. 26, 2022

(51) Int. Cl.
*A45F 5/00* (2006.01)

(52) U.S. Cl.
CPC ..... *A45F 5/00* (2013.01); *A45F 2005/008* (2013.01); *A45F 2200/0516* (2013.01)

(58) Field of Classification Search
CPC ..... A45F 5/00; A45F 2005/008; A45F 2200/0516
See application file for complete search history.

(56) References Cited

U.S. PATENT DOCUMENTS 7,568,719 B2 * 8/2009 Sauter ..... A63C 10/04 280/634
7,950,112 B2 * 5/2011 Hammerslag ..... A43B 5/16 36/50.5
8,091,182 B2 * 1/2012 Hammerslag ..... A43C 11/16 36/50.5
D664,259 S * 7/2012 Joseph ..... D24/192
8,763,209 B2 7/2014 Kavarsky et al.
9,072,341 B2 * 7/2015 Jungkind ..... A43C 11/165
9,144,168 B2 * 9/2015 Sedillo ..... A45F 5/00
(Continued)

FOREIGN PATENT DOCUMENTS

CN 206197177 U 5/2017
CN 110448013 A 11/2019

OTHER PUBLICATIONS

"Wrist mount for Zebra TC51-TC52-TC56-TC57 (Size: L—265mm)," POSdata, 4 pages, (2022). [Retrieved from the Internet Aug. 31, 2022: <URL https://www.posdata.eu/product/1536/wrist-mount-for-zebra-tc51-tc52-tc56-tc57-size-l-265mm.html>].

*Primary Examiner* — Justin M Larson
(74) *Attorney, Agent, or Firm* — Alston & Bird LLP

(57) ABSTRACT

Various embodiments are directed to strap assemblies for securing a mobile device relative to an arm of a user and methods of using the same. Various embodiments are directed to a strap assembly comprising a strap panel comprising a rachet cable tension adjustment slot, a ratchet assembly for selective tightening of the strap assembly towards an arm and comprising a ratchet element on the strap panel; a dynamic cable attachment element disposed within the rachet cable tension adjustment slot and configured to move along a length of the rachet cable tension adjustment slot; and a ratchet cable extending between the ratchet element and the dynamic cable attachment element and having a looped cable portion configured for attachment to the dynamic cable attachment element; wherein the dynamic cable attachment element is movable along the length of the rachet cable tension adjustment slot in response to forces imparted from the ratchet cable.

20 Claims, 5 Drawing Sheets

(56) References Cited

U.S. PATENT DOCUMENTS

| | | | | |
|---|---|---|---|---|
| 9,661,912 | B1 * | 5/2017 | Chung | A45F 5/00 |
| 9,693,622 | B1 * | 7/2017 | Hackett | A45C 11/00 |
| 9,706,814 | B2 * | 7/2017 | Converse | A61F 5/0123 |
| 9,770,070 | B2 * | 9/2017 | Cotterman | A43C 11/20 |
| 9,844,340 | B2 | 12/2017 | Fish et al. | |
| 9,918,865 | B2 * | 3/2018 | Nickel | A61F 5/01 |
| 9,991,922 | B2 * | 6/2018 | Kovacs | A45F 5/00 |
| 10,143,295 | B2 * | 12/2018 | Palma | A45F 5/004 |
| 10,492,568 | B2 * | 12/2019 | Burns | F41C 33/0209 |
| D884,197 | S * | 5/2020 | Hyder | D24/190 |
| 10,663,150 | B1 * | 5/2020 | Luna | F21L 4/04 |
| 10,702,409 | B2 * | 7/2020 | Burns | A61F 5/0102 |
| 10,756,773 | B2 * | 8/2020 | Kovacs | H04M 1/04 |
| 10,874,175 | B2 * | 12/2020 | So | A44B 11/065 |
| 10,959,492 | B2 * | 3/2021 | Converse | A61F 5/0123 |
| 11,033,079 | B2 * | 6/2021 | Bock | A43B 3/36 |
| 11,140,969 | B2 * | 10/2021 | Alley | F41H 1/00 |
| 11,344,086 | B2 * | 5/2022 | Fiedler | A61F 5/01 |
| 11,412,837 | B2 * | 8/2022 | Choi | A45F 5/00 |
| 11,583,058 | B2 * | 2/2023 | Dunbar | G06K 7/1417 |
| 11,596,219 | B2 * | 3/2023 | Alley | F41C 33/00 |
| 2003/0204938 | A1 * | 11/2003 | Hammerslag | A43C 11/004 24/68 SK |
| 2005/0198866 | A1 * | 9/2005 | Wiper | A43B 5/14 36/50.1 |
| 2008/0249448 | A1 * | 10/2008 | Stevenson | A61F 5/0125 602/5 |
| 2009/0172928 | A1 * | 7/2009 | Messmer | A43C 7/00 242/407.1 |
| 2012/0246974 | A1 * | 10/2012 | Hammerslag | A43C 11/004 36/83 |
| 2015/0150705 | A1 * | 6/2015 | Capra | A61F 5/0123 602/6 |
| 2022/0248810 | A1 * | 8/2022 | Fiedler | A45C 13/1038 |

* cited by examiner

STRAP ASSEMBLY FOR A WEARABLE MOBILE DEVICE AND METHOD OF USING THE SAME

FIELD OF THE INVENTION

Various embodiments described herein relate generally to armband fastening assemblies configured to securely attach a mobile device to an object such as a user's arm.

BACKGROUND

Applicant has identified many technical challenges and difficulties associated with attaching a mobile device to a mobile device user's arm. Through applied effort, ingenuity, and innovation, Applicant has solved problems related to these wearable accessory arm straps by developing solutions embodied in the present disclosure, which are described in detail below.

BRIEF SUMMARY

Various embodiments are directed to strap assemblies for wearable mobile devices and methods of using the same. In various embodiments, a strap assembly for wearable mobile devices may comprise a strap panel comprising a rachet cable tension adjustment slot; a ratchet assembly configured to facilitate selective tightening of the strap assembly towards an arm of a user, the rachet assembly comprising: a ratchet element arranged on the strap panel; a dynamic cable attachment element disposed within the rachet cable tension adjustment slot and configured to move throughout a range of motion defined along a length of the rachet cable tension adjustment slot; and a ratchet cable extending at least between the ratchet element and the dynamic cable attachment element, the ratchet cable being defined at least in part by a looped cable portion configured for attachment to the dynamic cable attachment element; wherein the dynamic cable attachment element is configured to be moved along the length of the rachet cable tension adjustment slot in response to one or more forces imparted on the dynamic cable attachment element from the ratchet cable.

In various embodiments, one or more forces may be imparted on the dynamic cable attachment element from the ratchet cable are defined at least in part by first tension at a front strap portion of the strap assembly and a second tension at a rear strap portion of the strap assembly. In certain embodiments, the strap assembly may be configured such that a movement of the dynamic cable attachment element to an offset position along the length of the rachet cable tension adjustment slot causes the first tension and the second tension to be at least partially equilibrated. Further, the front strap portion may be configured to engage a first arm portion of the arm of the user and the rear strap portion is configured to engage a second arm portion of the user, wherein the first arm portion is defined by a first diameter and the second arm portion is defined by a second diameter that is at least substantially different than the first diameter. Further still, the strap assembly may be configured such that a position of the dynamic cable attachment element within the ratchet cable tension adjustment slot corresponds at least in part to a difference in the first diameter and the second diameter.

In various embodiments, the dynamic cable attachment element may define a nominal position within the ratchet cable tension adjustment slot wherein the dynamic cable attachment element is at least substantially aligned with the ratchet element along a vertical axis. In various embodiments, the strap panel may be configured for engagement with a device holder to facilitate an at least partial attachment of the strap assembly to the device holder. In various embodiments, the strap assembly may further comprise a band configured to extend around at least a portion of the arm of the user to at least partially secure the strap assembly relative to the arm of the user, wherein the band is attached at a first end to the strap panel. In certain embodiments, the ratchet cable may be further configured to engage at least a portion of the band such that the selective tightening of the strap assembly comprises a second force being imparted on the band from the ratchet cable. Further, in certain embodiments, the ratchet cable may be configured to engage the band at a band cable anchor element fixedly secured to the band.

In various embodiments, the length of the ratchet cable tension adjustment slot may extend between a first slot end and a second slot end, and wherein the ratchet cable tension adjustment slot is defined by a curved profile. In certain embodiments, the first slot end and the second slot end may each define vertical positions that are beneath a corresponding vertical position of a center of the ratchet cable tension adjustment slot such that the curved profile defines a downward-facing arc. In certain embodiments, the ratchet cable tension adjustment slot may be arranged along the strap plate such that the first slot end and the second slot end are equidistant from the ratchet element.

In various embodiments, a movement of the dynamic cable attachment element from a nominal position may be defined by the central position along the length of the ratchet cable tension adjustment slot an offset position at a first end of the ratchet cable tension adjustment slot corresponds to an angular movement of the dynamic cable attachment element about the ratchet element through an angle of between 30 degrees and 60 degrees. In various embodiments, the strap assembly may further comprise a second strap panel positioned on an opposing lateral side of the strap assembly relative to the strap panel and comprising a second rachet cable tension adjustment slot, a second ratchet element arranged on the second strap panel; and a second dynamic cable attachment element disposed within the second rachet cable tension adjustment slot and configured to move throughout a second range of motion defined along the second rachet cable tension adjustment slot. In certain embodiments, the ratchet cable may be further configured to engage the second the dynamic cable attachment element and the second ratchet element, the ratchet cable including a second looped cable portion configured for attachment to the second dynamic cable attachment element. In certain embodiments, the strap assembly may further comprise a second ratchet cable extending between the second ratchet element and the second dynamic cable attachment element, the second ratchet cable being defined at least in part by a second looped cable portion configured for attachment to the second dynamic cable attachment element.

In various embodiments, the ratchet element is configured to receive a user interaction therewith and initiate the tightening of the strap assembly based at least in part on the user interaction. In various embodiments, a wearable mobile device holder configured to secure a mobile device relative to the arm of the user may comprise the strap assembly. In certain embodiments, the wearable mobile device holder comprising the strap assembly may further comprise a device holder configured for securing the mobile device therein, wherein the strap panel comprises one or more device holder attachment features configured to facilitate an attachment of the device holder to the strap assembly.

BRIEF DESCRIPTION OF THE DRAWINGS

Reference will now be made to the accompanying drawings, which are not necessarily drawn to scale, and wherein.

DETAILED DESCRIPTION

Figure 1:
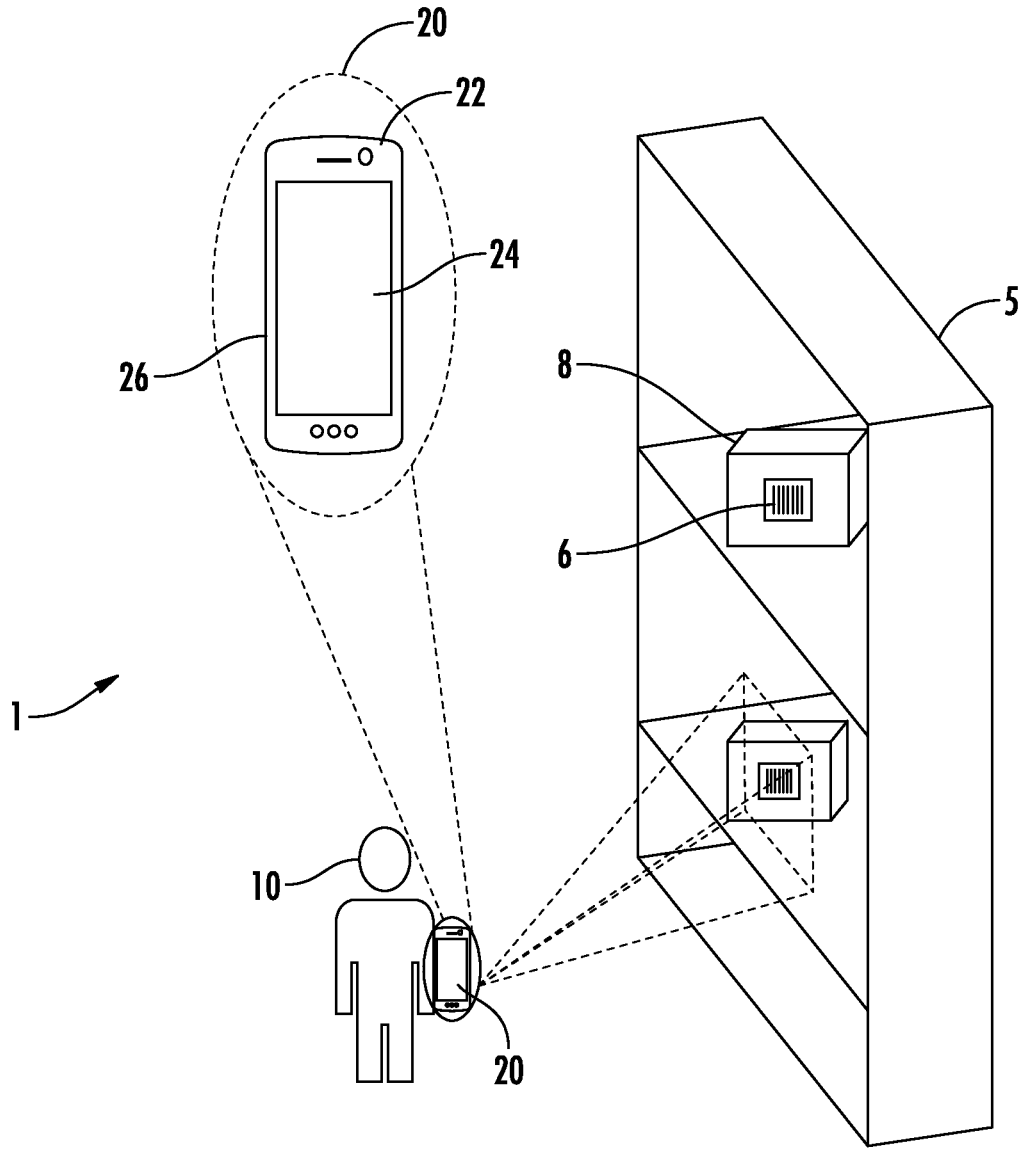
FIG. 1 illustrates an exemplary environment where a device may be used, according to one or more embodiments described herein.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

It should be understood at the outset that although illustrative implementations of one or more aspects are illustrated below, the disclosed assemblies, systems, and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents. While values for dimensions of various elements are disclosed, the drawings may not be to scale.

The words "example," or "exemplary," when used herein, are intended to mean "serving as an example, instance, or illustration." Any implementation described herein as an "example" or "exemplary embodiment" is not necessarily preferred or advantageous over other implementations.

Various example embodiments address technical problems associated with attaching and operably holding a mobile device to an object, such as a user's arm. As understood by those of skill in the field to which the present disclosure pertains, there are numerous scenarios in which it is beneficial to attach a mobile device to an object, such as a user's arm. Attaching a mobile device to a user's arm, for example, allows the user the benefit of continued use of their hands while utilizing a mobile device while minimizing the risk of damage or loss of the mobile device. The positioning of the mobile device that is created by the device holders and various fastening mechanisms disclosed herein may also allow improved, intuitive functioning of the mobile device, such as hands-free scanning of decodable indicia. Many devices used to attach a mobile device to a user's arm are difficult to securely attach without the use of both hands. In addition, many devices may be tailored for a right-handed or left-handed attachment and not easily utilized on either hand. Further, many devices used to attach a mobile device to a user's arm are difficult to fully and/or comfortably secure to the arm of a user because the tapered configuration of an arm—naturally including a narrower portion at a user's wrist and a wider portion at the user's forearm—causes the tension within the device as it is tightened to the user's arm to be different at various portions throughout the device. Such a tension imbalance can result in operational inefficiencies or undesirable user configurations in which the device is either insufficiently tightened at a narrower portion of the user's arm or overly tightened at the wider portion of the user's arm. One skilled in the field to which the present disclosure pertains will appreciate further problems that may be resolved by various embodiments of the present disclosure.

The various embodiments herein, including but not limited to a strap assembly utilize various features to comfortably and effectively secure a wearable device holder to the arm of a user. For example, in various embodiments, the present invention includes a strap assembly comprising a ratchet cable tension adjustment slot provided within a strap panel thereof, and a dynamic cable attachment element configured for movement in one or more directions along the length of the ratchet cable tension adjustment slot to skew the cable tension acting on the strap assembly in order to accommodate the tapered configuration of a user's arm. The strap assembly may include a ratchet assembly configured to facilitate selective tightening of the strap assembly, including a ratchet cable having a looped portion that is engaged with the dynamic cable attachment element. The ratchet cable may be configured to extend at least between the dynamic cable attachment element and a ratchet element disposed along the strap plate such that as the dynamic cable attachment element is moved throughout a range of motion defined along the length of the ratchet cable tension adjustment slot, the angular configuration of the portion of the ratchet cable extending between the ratchet element and the dynamic cable attachment element may be similarly reconfigured. Accordingly, such a movement of the dynamic cable attachment element from a nominal position towards an end of the ratchet cable tension adjustment slot (e.g., to an offset position) causes one or more tension forces within the strap assembly to be skewed in a direction that offsets, alleviates, and/or redirects at least a portion of the tension imbalance present within the strap assembly as a result of the tapered configuration of a user's arm. The strap assembly described herein utilizes the dynamic configuration of the dynamic cable adjustment element to skew the cable tension within the strap assembly to equilibrate the tensions within the strap assembly at the front strap portion and the rear strap portions engaged with the narrower and wider arm portions of the user's arm, respectively. By equilibrating the tension at the narrow and wider arm portions of the user's arm (e.g., the wrist and the forearm), the present invention decreases the operational inefficiencies associated with the strap assembly having a loose fit on the user's arm, and eliminates the potentially dangerous conditions that can result from a loose-fitting strap assembly becoming disengaged with the user's arm. Further, by equilibrating the tension at the narrow and wider arm portions of the user's arm, the present invention increases the comfort for a user during use by reducing the need to overtighten the strap assembly at the wider arm portion to ensure a secure fit at the narrower arm portion. The present invention includes a dynamically configured strap assembly that minimizes the amount of user interaction required to achieve a comfortable fit on the user's arm by utilizing the natural forces with the assembly to at least substantially automatically equilibrate the tension at the narrower and wider portions of the user's arm upon tightening of the strap assembly. Further, as described herein, the present invention is configured to allow for ambidextrous control of the assembly such that a user may comfortably wear the strap assembly on either arm and control the assembly and/or the mobile device engaged therewith using either a right hand or a left hand.

FIG. 1 illustrates an exemplary environment 1 where a mobile device 20 may be used, according to one or more embodiments described herein. The exemplary environment 1 may include the mobile device 20, a user 10, a rack 5 and one or more objects 8 placed on the rack 5.

The mobile device 20 may include one or more components, circuitry, software modules, and/or the like that may enable the mobile device 20 to perform a predetermined operation in the exemplary environment 1. For example, the user 10 may utilize the mobile device 20 to scan the one or more objects 8 to obtain information pertaining to the one or more objects 8. In an example embodiment, the mobile device 20 may include an image capturing device 22 that may enable the mobile device 20 to capture an image of a barcode 6 on the one or more objects 8 and accordingly, obtain the information pertaining to the one or more objects 8 by decoding the barcode 6. Further, the mobile device 20 may include a communication module (not shown) that may enable the mobile device 20 to transmit the information pertaining to the one or more objects 8 to a remote computer. Furthermore, the mobile device 20 may include a display screen 24 that may display a user interface (UI) to the user 10. The user 10 may control the operation of the mobile device 20 based on inputs provided through the UI displayed on the display screen 24. Further, the display screen 24 may be configured to display the information pertaining to the one or more objects 8.

In some examples, the scope of the disclosure is not limited to the mobile device 20 comprising the image capturing device 22, the communication module, and the display screen 24. In an example embodiment, the mobile device 20 may include other electronic and mechanical components that enable the mobile device 20 to perform other operations, without departing from the scope of the disclosure. In an example embodiment, the mobile device 20 has a housing 26 that may be configured to partially or fully enclose the mobile device 20. For example, the housing 26 may be configured to partially or fully enclose the communication module, the display screen 24, and the image capturing device 22.

Figure 2:
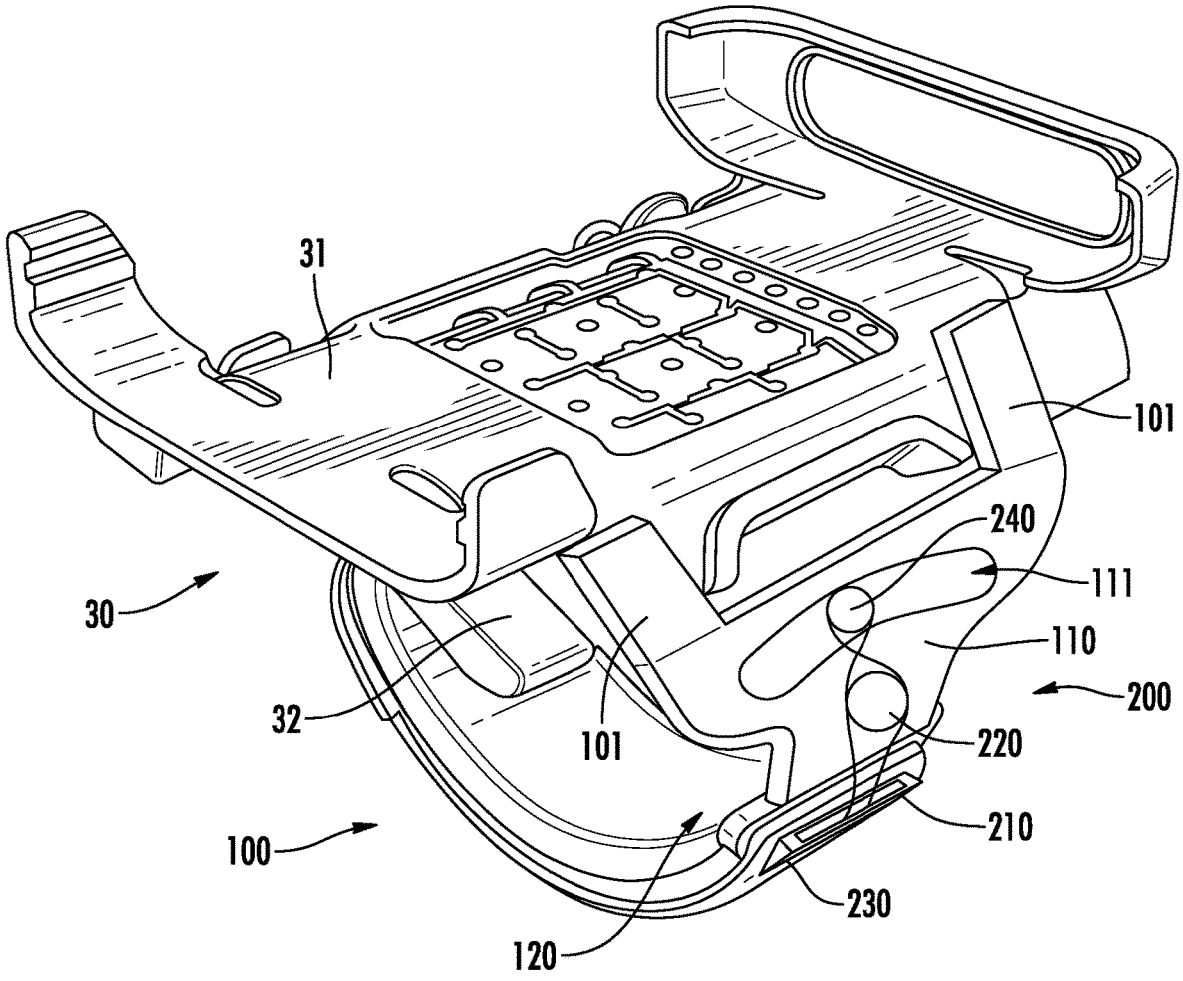
FIG. 2 illustrates a perspective view of a device holder and a strap assembly in accordance with one or more example embodiments described herein.
Figure 4:
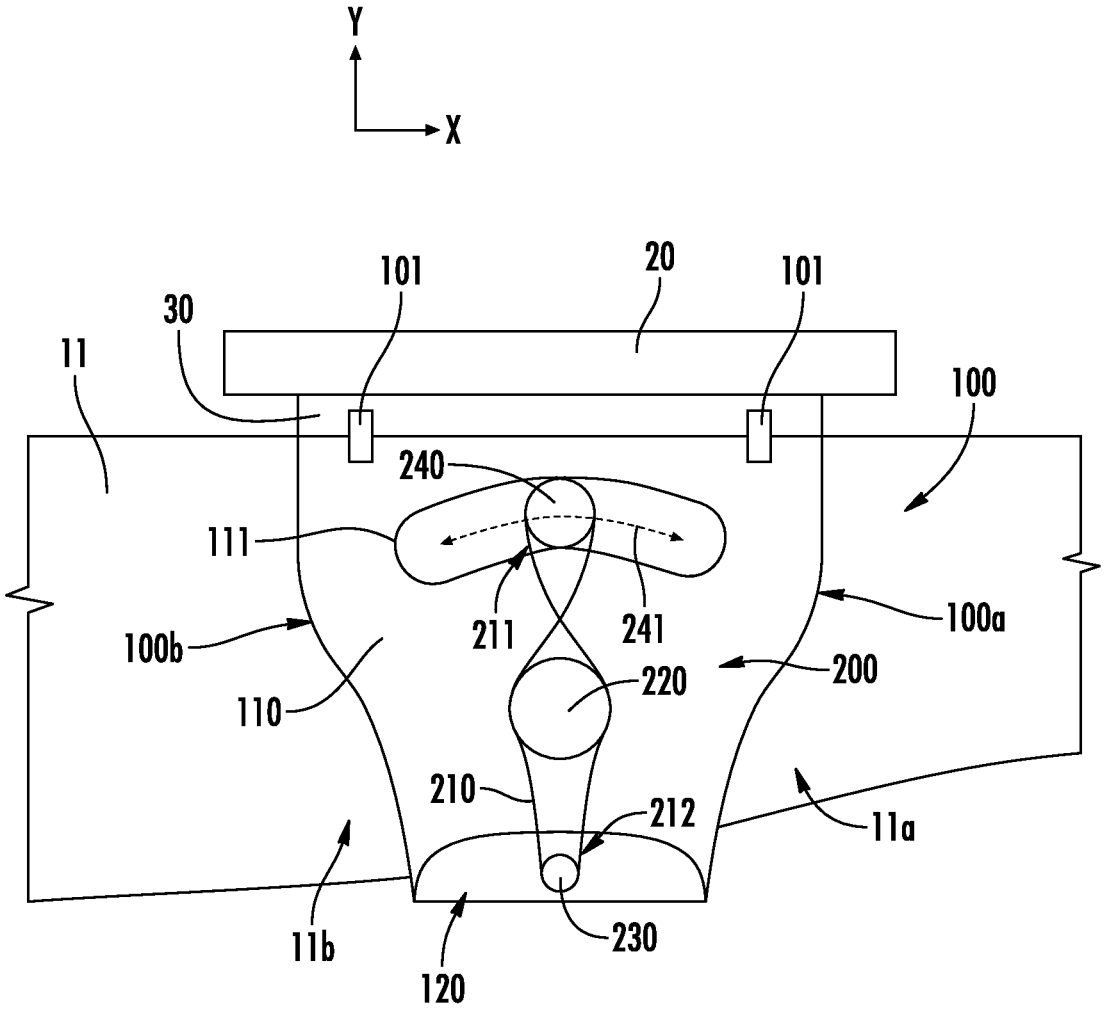
FIG. 4 illustrates a side view of a device holder and a strap assembly being worn on an arm of a user in accordance with one or more example embodiments described herein.

FIG. 2 illustrates a perspective view of a device holder and a strap assembly in accordance with one or more example embodiments described herein. In particular, FIG. 2 illustrates an exemplary device holder 30 configured for attaching a mobile device (e.g., mobile device 20 shown in FIG. 1) to an object, such as, for example, the arm 11 of a user 10 as shown in FIGS. 4-5B, in order to facilitate use of the mobile device without occupying one or both of the user's hands. It will be appreciated that the illustrated device holder 100 and various depicted embodiments herein are provided as example embodiments and should not be construed to narrow the scope or spirit of the disclosure in any way.

Figure 3:
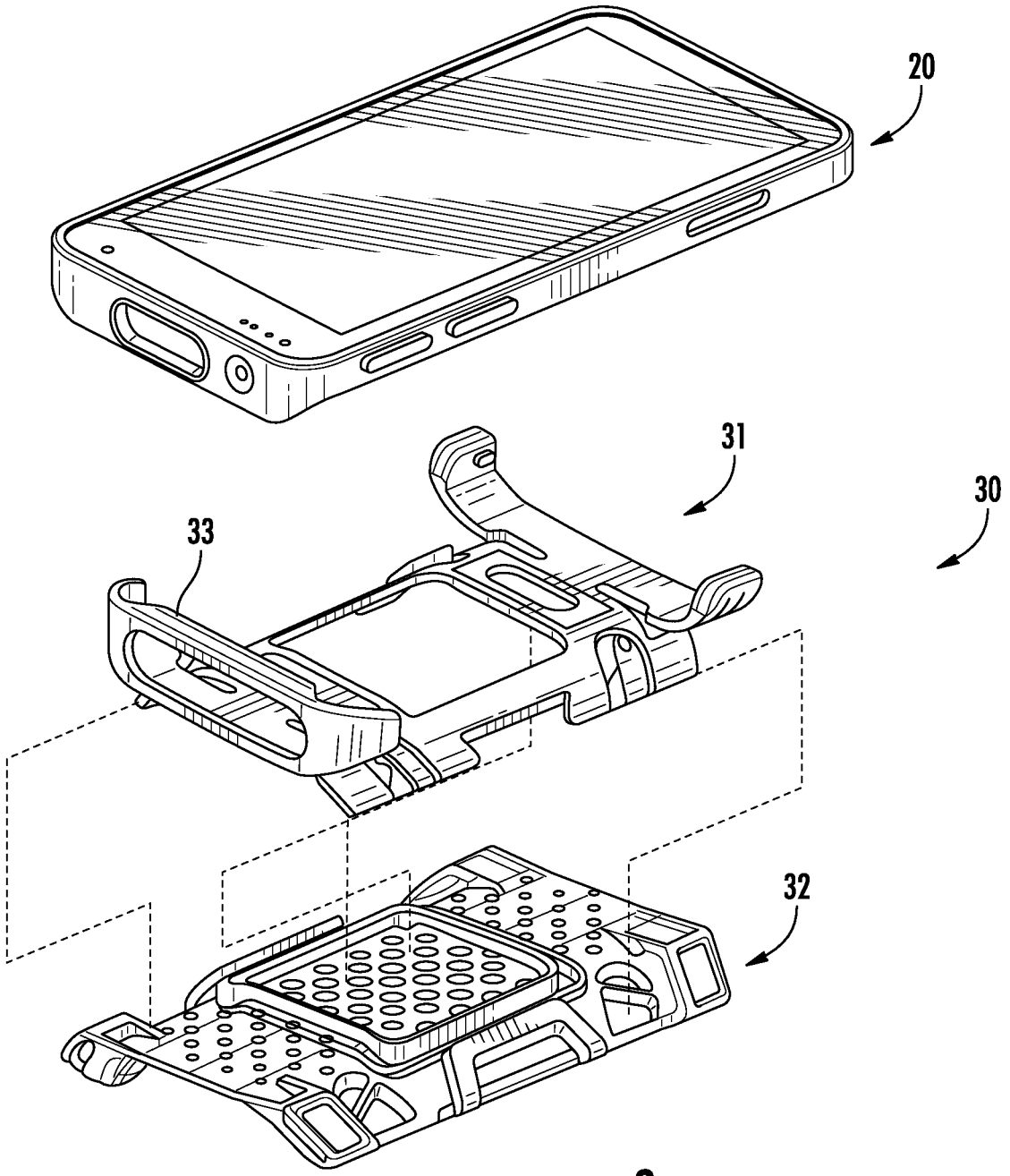
FIG. 3 illustrates an exploded view of a device holder and a mobile device in accordance with one or more example embodiments described herein.

In various embodiments, an exemplary device holder 30 may include an inner body 32 and an outer body 31 layered atop the inner body 32, where the inner body 32 may be attached to the underneath side of the outer body 31. For example, FIG. 3 illustrates an exploded view of a device holder 30 and a mobile device 20 in accordance with one or more example embodiments described herein. The depicted device holder 30 of FIG. 3 includes an inner body 32 positioned underneath an outer body 31. In some embodiments, the device holder 30 may be symmetric about its center, longitudinal axis. In some embodiments, the outer body 31 may be formed or shaped to fit a generic shape corresponding to the arm of a user to which the device holder 30 will be attached. For example, an inner surface of the outer body 31 may define an at least partially concave shape. In the depicted embodiment, the outer body 31 includes a generally flat central portion of the inner surface and concave outer edge portions of the inner surface.

Further, in various embodiments, the outer body 31 may include a device carriage 33 comprising a structure, device, and/or the like configured to engage a mobile device and at least partially secure the mobile device to the remainder of the device holder 30. Alternatively, and/or additionally, in various embodiments, the device carriage 33 may be a separate body or feature that may be attached to the remaining components of the device holder 30 (e.g., to the outer and/or inner bodies) to secure the mobile device. For example, the device holder 30 may be configured to receive an exemplary mobile device at the device carriage 33 and at least partially secure the mobile device in an operation position within and/or atop the outer body 31 relative to the arm of a user wearing the device holder 30. In various embodiments, the inner body 32 of an exemplary device holder 30 may be formed to securely attach to the outer body 31, such as, for example, with a latching mechanism and/or other coupling means.

Further, as illustrated, the inner body 32 of an exemplary device holder 30 may be configured to engage at least a portion of a user's arm in an exemplary circumstance wherein the device holder 30 is attached to an exemplary strap assembly, as described herein. In some embodiments, the inner body 32 may be permanently attached to the outer body 31, for example, with an adhesive or other permanent attachment.

In various embodiments, a device holder 30 may comprise one or more strap assembly attachment features configured to facilitate an attachment of the device holder 30 to a strap assembly such as, for example, the exemplary strap assembly 100 illustrated in FIG. 2, that is configured to be worn by a user such that the device holder 30 (e.g., and a mobile device secured therein) may be secured relative to an arm of the user. For example, in various embodiments, the one or more strap assembly attachment features of the device holder 30 may be defined by the inner body 32, which may be configured to engage and/or be engaged by a corresponding one or more device holder attachment features 101 of the strap assembly 100 in order to facilitate an attachment of the device holder 30 to the strap assembly 100. Alternatively, or additionally, at least a portion of the one or more strap assembly attachment features of the device holder 30 may be defined by the outer body 31 such that the strap assembly 100 (e.g., the device holder attachment features 101) may be secured relative to the device holder via a connected with the outer body 31.

In various embodiments, an exemplary strap assembly 100 may comprise a band 120 configured to define a selectively adjustable length between two ends thereof, at least one of the ends being attached to an adjustable strap panel 110, and a ratchet assembly 200 at least partially engaged with the strap panel 110 and configured to facilitate selective tightening of the strap assembly 100. In various embodiments, an adjustable strap panel 110 is configured to engage device holder 30 to facilitate an at least partial attachment of strap assembly 100 to device holder 30. In various embodiments, the strap panel 110 of the strap assembly 100 may comprise an at least partially rigid material portion of the strap assembly 100 that is configured to engage at least a portion of the device holder 30 to facilitate an at least partial connection between the device holder 30 and the strap assembly 100. For example, in various embodiments, the strap panel 110 may comprise a rigid panel component having a material thickness and being configured to receive, engage, and/or otherwise interact with at least a portion of a ratchet assembly 200 of the strap assembly 100 to enable the adjustable configuration of the strap assembly 100, as described herein.

In various embodiments, the strap panel 110 may include one or more device holder attachment elements 101 attached thereto comprising a fastening means, such as, for example, hook and loop fasteners, snaps, buttons, magnets, and/or the like, including any mechanism that may be used to facilitate the coupling of the strap panel 110 to a corresponding portion of the device holder 30. For example, the one or more device holder attachment elements 101 may be positioned to at least partially attach the device holder 30 to the strap assembly 100 (e.g., the strap panel 110) such that the device holder 30 (e.g., and a mobile device secured therein) may be secured relative to an arm of a user. In various embodiments, the strap panel 110 may be configured for attachment to both the device holder 30 and a band 120 that is configured to engage the arm of a user, as described herein. In such an exemplary circumstance, the first strap panel 110 may embody an intermediate strap portion that is directly and/or indirectly engaged with the band 120 and configured to define an adjustable configuration of the strap assembly 100 (e.g., relative to a user's arm) based at least in part on a range of relative motion between respective portions of the first and bands 110, 120, as described herein.

In various embodiments, for example, as illustrated in FIG. 2, a strap assembly 100 may comprise a band 120 configured for attachment with strap panels 110 on each of the respective ends thereof and, further, for engagement with the arm of a user. For example, in various embodiments, the band 120 may be defined by any structure designed to connect to a strap panel 110 engaged with a deice holder 30 and pass under a user's arm so as to define an enclosed opening within which at least a portion of a user's arm may be positioned during the wearing of the strap assembly 100 and/or the device holder 30. The band 120 may be configured to engage the user's arm so as to secure the device holder 30 (e.g., and a mobile device disposed therein) connected to the strap panel 110 in a position relative to the user's arm. In some embodiments, for example, the band 120 may comprise a sleeve, strap, belt, band, fastener, and/or any other portion(s) of material(s) capable of securing the device holder 30 to an object (e.g., a user's arm) engaging the strap panel 110 and wrapping at least partly around the object (e.g., user's arm) to cause the device holder 30 to be held against a surface of the object. In some embodiments, the band 120 may comprise a material intended to comfortably contact a user's arm, for example, a sleeve, a fabric, a breathable material, or similar fabric or material. In some embodiments, the band 120 may include padding or other material adjacent to the user's arm to provide comfortable contact with the user's arm. In various embodiments, the band 120 may have a first strap panel 110*a* and a second strap panel 110*b* attached on the respective ends thereof, the first and second strap panels 110*a*, 110*b* being configured for attachment to respective sides of the device holder 30.

In various embodiments, as illustrated in FIG. 2, an exemplary strap assembly 100 may comprise one or more strap panels 110 comprising a rachet cable tension adjustment slot 111. As described in further detail herein, a portion of a ratchet assembly 200 may be dynamically engaged with the strap panel 110 such that portion of a ratchet assembly may be moved along the length of the 111 in response to an imbalanced tension distribution along the length of the strap assembly 100 as the strap assembly is being tightened. For example, such an exemplary imbalanced condition may be caused by a variation in diameter (e.g., tapering) along the portion of the user's arm to which the strap assembly 100 is being tightened, such as, for example, where the strap assembly 100 is positioned between a narrow arm portion adjacent a user's wrist and a wide arm portion of the user's forearm. One or more tension forces generated as a result of the tapered profile of a user's arm may be realized at a dynamic cable attachment element of the ratchet assembly that is configured for movement within the rachet cable tension adjustment slot 111. In such an exemplary circumstance, such forces may cause the dynamic cable attachment element to be pulled along the length of the rachet cable tension adjustment slot 111 in a direction at least partially towards the end of the strap assembly 100 at which the tension is the highest (e.g., the back end of the strap assembly 10, as measured along the length thereof, that is tightened around the relatively thicker portion of the user's arm). For example, such a movement of the dynamic cable attachment element 240 along the rachet cable tension adjustment slot 111 may cause the angular configuration of the dynamic cable attachment element 240 relative to the ratchet element 220 to be changed. The movement of the dynamic cable attachment element 240 along the rachet cable tension adjustment slot 111 relative to the slot plate 110 in response to the imbalance in the tensions at the respective ends of the strap assembly 100 may cause the tension within the strap assembly 100 to be skewed in a direction that alleviates and/or redistributes at least a portion of the tension imbalance. As a result, the strap assembly 100 is configured to enable an equilibrated tightening of the strap assembly 100 at both the narrower and wider portions of the user's arm.

FIG. 4 illustrates a side view of a device holder and a strap assembly being worn on an arm of a user in accordance with one or more example embodiments described herein. In particular, FIG. 4 illustrates an exemplary strap assembly 100 comprising a ratchet cable tension adjustment slot 111 provided within a strap panel 110 thereof and a dynamic cable attachment element 240 configured for movement in one or more directions along the length of the 111 to skew the cable tension acting on the strap assembly 100 to equilibrate the respective tension forces at the narrower and wider portions of a user's arm throughout the tightening of the strap assembly 100.

In various embodiments, an adjustment of the strap assembly 100 may be defined by a relative motion between the band 120 and at least a portion of the trap panel 110 (e.g., a portion of the strap panel 110 attached to the device holder 30) that corresponds to a reduction (and/or expansion) in the length of the band 120 that is being used to engage the arm of a user to secure the strap assembly 100 relative to the arm 11. In various embodiments, the strap assembly 100 may be adjusted based at least in part on a user interaction with the ratchet assembly 200, such as, for example, a ratchet element 220 provided at an outer surface of the strap panel 110.

For example, a user may engage and/or manipulate the ratchet element 220 so as to cause at least a portion of the band 120 to be pulled in a direction towards the strap assembly 110 in order to reduce the cross-sectional area of the opening defined by the strap assembly 100 (e.g., the within the curved arm of the band 120) through which an arm 11 may be extended in order for a user to wear the strap assembly 100 and the device holder 30 attached thereto. As illustrated, in various embodiments the length of the strap assembly 100 may be defined between a front strap portion and a rear strap portion (e.g., as defined in a longitudinal direction) and may be configured to be tightened against a portion of a user's arm 11 that is defined by tapered configuration, For example, the front strap portion may be configured to engage a narrow arm portion 11*a*, such as, for example, the wrist of a user, and the rear strap portion may be configured to engage a wider arm portion 11*b*, such as, for example, a portion of the user's forearm closer to the user's elbow. Accordingly, as described herein, the strap assembly is 100 is tightened (e.g., via the ratchet assembly 200) by reducing the cross-sectional area of the opening defined within the strap assembly 100 until it fits securely on the arm 11 of the user, a back strap portion 100*b* of the strap assembly 100 may be substantially tightened while the front strap portion 110*a* aligned with the narrow arm portion 11*a* of the arm may still have a loose fit that still allows for a relative motion between the user's arm 11 and the strap assembly 100. In various embodiments, such an exemplary circumstance by cause a discrepancy between the tension forces at the front strap portion 100*a* and the rear strap portion 100*b* of the strap assembly 100. The strap assembly 100 described herein may be configured to equilibrate the aforementioned tension discrepancy along the length of the strap assembly 100 based at least in part on the dynamic configuration of the dynamic cable attachment element 240 along the ratchet cable tension adjustment slot 111 that allows the tension to be dynamically skewed in one or more directions as the strap assembly 100 is being tightened.

As illustrated, in various embodiments and exemplary strap assembly 100 may comprise a strap panel 110 having a ratchet cable tension adjustment slot 111 that extends through the thickness of the strap panel 110 and is configured to receive at least a portion of a dynamic cable attachment element 240 of the ratchet assembly 200 therein such that the dynamic cable attachment element 240 may be dynamically engaged with the strap panel 110 and configured for movement throughout a range of motion defined along the length of the ratchet cable tension adjustment slot 111. In various embodiments, the ratchet cable tension adjustment slot 111 may comprise a slot having a length that extends between a first slot end 111*a* and a second slot end 111*b* along the strap panel 110 and is defined by an at least partially curved profile. In various embodiments, the curved profile of the 111 may be configured such that as the dynamic cable attachment element 240 is moved along the length of the ratchet cable tension adjustment slot 111, the angular configuration of the dynamic cable attachment element 240 relative to the ratchet element 220 (e.g., relative to a vertical direction) is adjusted. Such an adjustment may cause a change in the direction of at least a portion of the tension forces within the acting on the strap assembly 100 so as to cause the tension therein to be skewed towards a direction configured to cause the tension at the narrower arm portion 11*a* and wider arm portion 11*b* of the arm 11 to be equilibrated. As a non-limiting example, in various embodiments, the ratchet cable tension adjustment slot 111 may comprise a length that is configured to enable a minimum required material width of the strap edges to maintain rigidity and integrity if stitched edges.

In such an exemplary circumstance, the ratchet cable tension adjustment slot 111 may be configured such that, as the strap assembly 100 is tightened on a tapered portion of a user's arm, the dynamic cable attachment element 240 dynamically engaged within the ratchet cable tension adjustment slot 111 may be slid, translated and/or otherwise moved along the curved profile of the ratchet cable tension adjustment slot 111 (e.g., as the result of the cable tension forces from the ratchet cable 210 acting thereon) to a position wherein the cable tension acting on the strap assembly 100 via the ratchet cable 210 and the dynamic cable attachment element 240 of the rachet assembly 200 is skewed in a direction that offsets, alleviates, and/or redirects at least a portion of the tension such that the tension forces at the front and rear strap portions 100*a*, 100*b* (e.g., the strap assembly 100 ends tightened against the narrow arm portion 11*a* and the wider arm portion 11*b*, respectively) are equilibrated. As illustrated in FIG. 4, in various embodiments, the curved profile of the ratchet cable tension adjustment slot 111 may comprise an at least substantially "U"-shaped curve such that the strap assembly 100 is configured to enable a range of different skewed tension angles configured to accommodate a variety of angular tension imbalances resulting from any number of diameter differences between the respective ends of a tapered arm portion. For example, in various embodiments, the curved profile of the ratchet cable tension adjustment slot 111 may be configured such that the first end and the second end thereof are equidistant from the ratchet element 220 positioned on the strap plate 110. Further, in various embodiments, the ratchet cable tension adjustment slot 111 may be configured such that a movement of the dynamic cable attachment element 240 along the ratchet cable tension adjustment slot 111 from a nominal position (e.g., vertically aligned with the ratchet element 220) to an offset position at a first end of the ratchet cable tension adjustment slot 111 may correspond to an angular movement of the dynamic cable attachment element 240 relative to the ratchet element 220 (e.g., a rotation of the dynamic cable attachment element 240 about an axis of rotation defined by the central axis of the ratchet element 220) that extends through an angle of at least approximately between 15 degrees and 75 degrees (e.g., between 40 degrees and 50 degrees). Further, as non-limiting examples, in various embodiments, the dynamic cable attachment element 240 may comprise a bolt, a pin, a latch, a hook, and/or any other suitable mechanical fastening means configured for coupling to a looped portion of the ratchet cable 210 and for dynamically engaging the strap panel 110 so as to define a range of motion along the length of the rachet cable tension adjustment slot 111.

In various embodiments, as illustrated in FIG. 4, an exemplary strap assembly 100 may comprise a ratchet assembly 200 providing a means of adjusting (e.g., tightening) the strap assembly 100 against a user's arm. In various embodiments, an exemplary ratchet assembly 200 may comprise a ratchet element 220, a ratchet cable 210, and a dynamic cable attachment element 240. In various embodiments, an exemplary ratchet assembly 200 configured to facilitate selective tightening of the strap assembly 100 based on user interaction with the ratchet element 220 disposed on an outward-facing surface of the strap panel 110. For example, in various embodiments, the ratchet element 220 may comprise a ratchet wheel, a knob, a gear, a lever, and/or the like, or any combination thereof, or any other mechanism configured to adjust (e.g., increase) the tension in a ratchet cable 210 engaged therewith based at least in part on a user interaction with the ratchet element 220 (e.g., applying one or more pulling forces, pushing forces, twisting forces, and/or the like).

In various embodiments, the ratchet cable 210 of the ratchet assembly 200 may be a cord. For example, a ratchet cable 210 comprising a cord attach to the dynamic cable attachment element 240 may be configured to form a loop. The loop of cord may be any cord, string, or material (or combination of materials) that forms a closed loop with an opening such that the cord, string, or material defined by the ratchet cable 210 may be passed over the top of dynamic cable attachment element 240. In some embodiments, the loop may comprise various materials, for example, a rachet cable 210 may be a length of cord that is attached at one or both ends to a band 120 (e.g., at respective band cable anchor elements), a strap panel 110, and/or a portion of the ratchet assembly 200, such as, for example, a dynamic cable attachment element 240 or the rachet element 220. For example, the ratchet cable 210 may be looped around the dynamic cable attachment element 240 at a first end, connected at a second end to portion of 120 (e.g., band ratchet cable anchor element 230 fixedly secured thereto), and engaged at a central portion of the cable 210 (e.g., one or more lengths of the cable 210 between the first and second ends 211, 212) with the ratchet element 220 that arranged at a portion of the strap panel 110 provided therebetween. While depicted in some embodiments as an elastic cord, the ratchet cable 210 used herein, including to form the loop shown in FIG. 4, may be any piece of material, rope, cord, or other similar structure capable of forming a looped configuration along a length thereof to engage a dynamic cable attachment element 240, whether elastic or inelastic.

As described in further detail herein, the ratchet assembly 200 may be configured to facilitate selective tightening of the 100 to a user's arm based on user interaction with the ratchet element 220 that causes a resulting increase in tension within the ratchet cable 210 that results in the device holder 30 and the band 120 of the strap assembly 100 being pulled towards one another. As the strap assembly 100 is tightened, the dynamic configuration of the dynamic cable attachment element 240 within the curved rachet cable tension adjustment slot 111 enables a movement of the dynamic cable attachment element 240 based on the directional configuration of the tension forces acting thereon that functions to alleviate and/or redirect at least a portion of the tension forces acting at one or more points along the length of the band 120 in order to enable an equilibrated tightening of the strap assembly 100 as the front and rear strap portions 100*a*, 110*b* are tightened against the narrower arm portion 11*a* and the wider arm portion 11*b*, respectively.

Figure 5A:
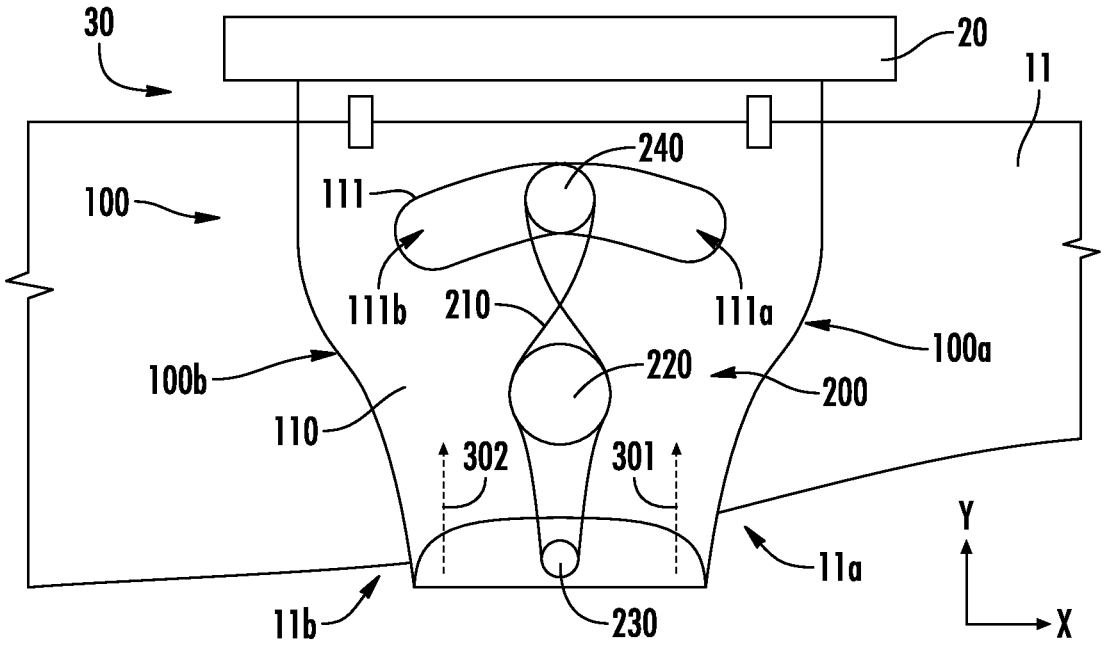
FIGS. 5A and 5B illustrate various side views of a device holder and a strap assembly being worn on an arm of a user in accordance with one or more example embodiments described herein.
Figure 5B:
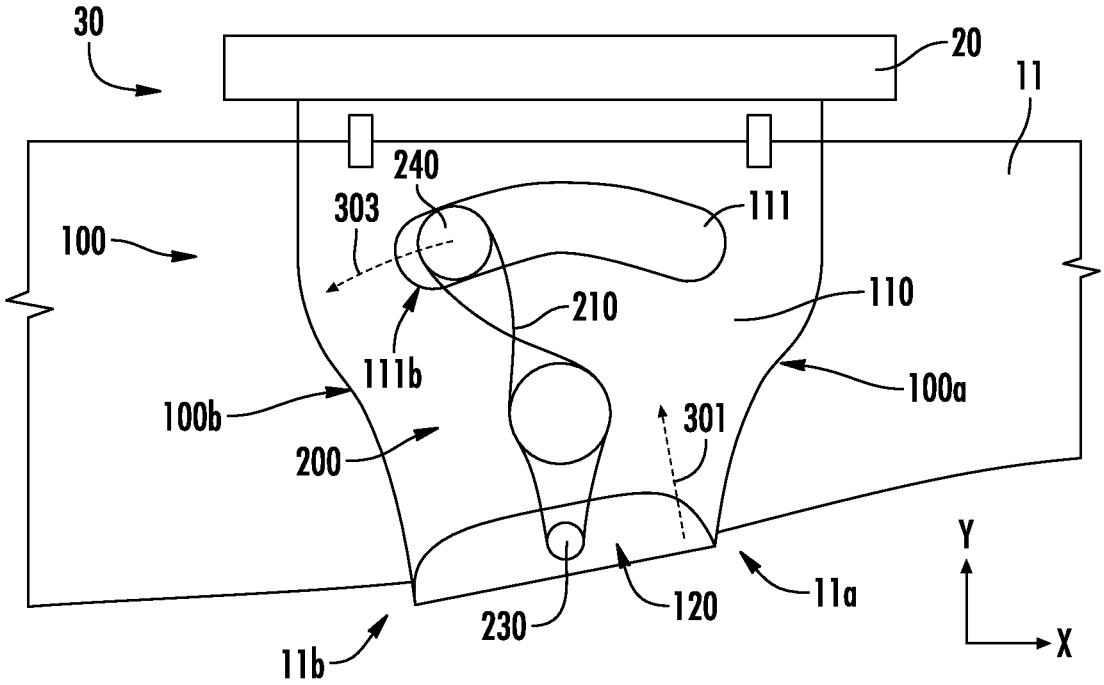

FIGS. 5A and 5B illustrate various side views of a device holder and a strap assembly being worn on an arm of a user in accordance with one or more example embodiments described herein. In particular, FIG. 5A shows an exemplary strap assembly 100 comprising one or more strap panels 110 having a rachet cable tension adjustment slot 111 defined therein and being configured to engage a device holder 30 to secure the device holder 30 (e.g., and a mobile device 20 secured therein) relative to the strap assembly 100 (e.g., relative to a user's arm 11), and a band 120 extending around at least a bottom portion of the arm 11. As illustrated, the strap assembly 100 may be defined by a length that extends in a longitudinal direction (e.g., in an x-direction according to the orientation illustrated in FIGS. 5A and 5B) between a front strap portion 100*a* and a rear strap portion 100*b*. Further, the exemplary strap assembly 100 comprises a ratchet assembly 200 including a dynamic cable attachment element 240 arranged within a rachet cable tension adjustment slot 111 of the strap panel 110 and configured for movement along the length thereof (e.g., between a front slot end 111 and a back slot end 111*b*). The dynamic cable attachment element 240 may be configured to facilitate a reconfiguration of the cable tension within the strap assembly 100 in order to equilibrate the tension forces present at the front strap portion 100*a* positioned adjacent a wrist arm portion 11*a* and the rear strap portion 100*b* positioned adjacent a forearm arm portion 11*b*. In various embodiments the ratchet assembly 200 may be configured for selective adjustment (e.g., tightening) of the strap assembly 100 relative to the arm 11 of a user based at least in part on the arrangement of connection of ratchet cable 210 relative to the dynamic cable attachment element 240 positioned within the strap panel 110, the band 120 (e.g., a band ratchet cable anchor element 230), and the ratchet element 220 positioned vertically therebetween so as to engage a central portion of the ratchet cable 210.

As described herein, the dynamic cable attachment element 240 is dynamically engaged with the strap panel 110 via a connection within the rachet cable tension adjustment slot 111 may define a range of motion extending along the length of the rachet cable tension adjustment slot 111 between the front slot end 111*a* and the back slot end 111*b*. In various embodiments, the dynamic cable attachment element 240 may be slidably configurable along the length of the rachet cable tension adjustment slot 111 between a nominal position and one or more offset positions.

For example, the exemplary strap assembly 100 illustrated in FIG. 5A is shown in a nominal position defined by the arrangement of the dynamic cable attachment element 240 in a position that is at least substantially vertically aligned with the rachet element 220 attached to the strap panel 110. In various embodiments, the strap assembly 100 may be configured such that a user engagement with the ratchet element 220 may cause a tension within at least a portion of the ratchet cable 210 to be increased, resulting in respective forces acting on each of the dynamic cable attachment element 240 and a portion of the band 120 engaged therewith (e.g., a band ratchet cable anchor element 230) such that the dynamic cable attachment element 240 and the portion of the band 120 engaged with the ratchet cable 210 are pulled towards one another (e.g., towards the ratchet element 202 positioned therebetween). The strap assembly 100 may be configured such that the tension within the ratchet cable 210 that pulls the dynamic cable attachment element 240 in a downward vertical direction (e.g., at least partially in a negative y-direction according to the orientation illustrated in FIG. 5A) may cause at least a portion of the device holder 30 secured on top of the strap panel 110 to be pulled in a correspondingly downward direction into a top surface of the user arm 11.

Further, the strap assembly 100 may be configured such that a tension within the portion of the ratchet cable 210 engaged with the band 120 may cause the band 120 to be pulled in an at least partially upward vertical direction (e.g., at least partially in a positive y-direction according to the orientation illustrated in FIG. 5A). For example, based at least in part on the exemplary configuration wherein the device holder 30 is being pulled into the top of the arm 11 and is unable to move further in the vertically downward direction, the band 120 may be pulled in an at least partially upward direction towards the bottom surface of the user arm 11. Such an exemplary movement of the band 120 of the strap assembly 100 towards a bottom portion of the arm 11 may embody a tightening action wherein the strap assembly 100 is adjusted to be tightened to fit an arm 11 using the ratchet assembly 200, as described herein. For example, as illustrated in FIG. 5A, when the dynamic cable attachment element 240 is arranged in a nominal position and the strap assembly 100 is being tightened such the band 120 is being pulled towards the arm 11, but has yet to be engaged and fully tensioned thereagainst, the tension forces from the ratchet cable 210 acting on the band 120 may be represented by equilibrated tension forces 301 and 302 acting on the band 120 in a vertically upward direction at a front strap portion 100*a* and a back strap portion 100*b* thereof, respectively. In such an exemplary configuration, as the strap assembly 100 is tightened towards the user arm 11, the equilibrated tension forces 301, 302 acting on the band 120 (e.g., and/or those acting on the dynamic cable attachment element 240) may be defined in an at least substantially vertical direction (e.g., in a y-direction according to the orientation illustrated in FIG. 5A) until one or more portions of the strap assembly 100, such as, for example, a rear strap portion 100*b*, are tightened to an extent that at least a portion of the strap assembly 100 is physically engaged with and tightened against an adjacent portion of the user arm 11. For example, as illustrated in FIG. 5A, the strap assembly may be tightened until the back strap portion 100*b* of the strap assembly 100 is engaged with and substantially tightened against the wider arm portion 11*b*. In such an exemplary circumstance, as illustrated, the front strap portion 110*a* may not yet be engaged with the narrow arm portion 11*a*, causing the strap assembly 100 to have a loose fit at the strap front end 100*a* that allows for a relative motion between the strap assembly 100 and the arm, the front still have a loose fit relative to the arm 11 that still allows for a relative motion between the user's arm 11 and the strap assembly 100.

With reference to FIG. 5B, an exemplary circumstance is depicted wherein the dynamic cable attachment element 240 is arranged in an offset position at a rear end of the ratchet cable tension adjustment slot 111 based on the strap assembly 100 depicted in FIG. 5A being further tightened using the ratchet assembly 200. As the strap assembly 200 is tightened further beyond the configuration depicted in FIG. 5A, tension forces may be generated within the strap assembly 100 based on the rear strap portion 100*b* being continuously pulled into the wide arm portion 11*b* of the arm 11 and the reactive forces imparted on the rear strap portion 100*b* from the wider arm portion 11*b*. A similar increase in tension is not realized at the front strap portion 100*a* until the strap assembly 100 is tightened to an extent wherein the front strap portion 100*a* is engaged and fully tensioned against the front arm portion 11*a*. Accordingly, based at least in part on the configuration of the ratchet assembly 200 and the connection of the ratchet cable 210 to the dynamic cable attachment element 240 within the ratchet cable tension adjustment slot 111, the discrepancy in the magnitude of the tensions at the front and rear strap portions 100*a*, 100*b* as the strap assembly 100 is being tightened to eliminate the loose fit present at the front strap portion 100*a* generates a resultant force that is imparted on the dynamic cable attachment element 240. In various embodiments, the resultant force may embody a pulling force configured to cause the dynamic cable attachment element 240 to be pulled along the length of the ratchet cable tension adjustment slot 111 towards the end thereof that is nearest the higher-tensioned end of the strap assembly (e.g., the rear strap portion 100*b*) For example, as illustrated in FIG. 5B, a resultant pulling force the tension imbalance at front and rear strap portions 100*a*, 100*b* and acting on the dynamic cable attachment element 240 may be defined at least in part by a longitudinal component (e.g., defined along the x-axis according to the exemplary orientation illustrated in FIG. 5B) that is oriented in a longitudinal direction toward the higher-tensioned rear strap portion 100*b* (e.g., in the negative x-direction, as illustrated).

In various embodiments, the strap assembly 100 may be configured such that such a resultant force may pull the dynamic cable attachment element 240 to a position along the length of the ratchet cable tension adjustment slot 111 to define a offset position. For example, the resultant force may be imparted on the dynamic cable attachment element 240 such that the dynamic cable attachment element 240 is moved in a direction 303 towards a rear end of the ratchet cable tension adjustment slot 111 nearest the higher-tensioned rear strap portion 100*b*. In various embodiments, the movement of the dynamic cable attachment element 240 to a offset position, as illustrated, may represent a change in angular configuration that causes the ratchet assembly 200 to tighten the strap assembly 100 by pulling the band 120 in a different and/or an at least partially angled direction (e.g., relative to the vertical direction) corresponding to the offset position of the dynamic cable attachment element 240. In various embodiments, the offset position of the dynamic cable attachment element within the ratchet cable tension adjustment slot 111 may correspond to the magnitude of the tension imbalance within the strap assembly 100, which may be defined by the difference in diameter of the arm 11 at the narrow arm portion 11*a* and the wider arm portion 11*b*. The strap assembly 100 being tightened with the dynamic cable attachment element 240 in an offset position results in the aforementioned tension imbalance between the front and rear strap portions 100*a*, 100*b* being at least partially alleviated by skewing the tension devoted to the front and rear strap portions 100*a*, 100*b*. For example, the dynamic cable attachment element 240 being moveable such that the tension devoted to the front and rear strap portions 100*a*, 100*b* can be skewed enables a configuration wherein the tensions acting on the narrow and wider arm portions 11*a*, 11*b* of the user's arm 11 as the strap assembly 100 is tightened are equilibrated.

Although various embodiments described herein make reference to an exemplary strap panel that is positioned on a lateral side of a strap assembly (e.g., extending longitudinally between a front strap portion and a rear strap portion) and comprises a ratchet cable tension adjustment slot with a dynamic cable attachment element disposed therein configured to be moved based on a ratchet assembly to alleviate a tension imbalance between the front strap portion and the rear strap portion, it should be understood that the present invention includes a strap assembly having both a first strap panel positioned on a first lateral side and a second strap panel positioned on an opposing second lateral side of the strap assembly, each being configured according to the various embodiments described herein (e.g., each having a respective ratchet cable tension adjustment slot with a respective dynamic cable attachment element disposed therein, and each being configured for engagement with a respective ratchet assembly). Further, in various embodiments, such an exemplary strap assembly may be configured for use on either a left arm or a right arm, thereby enabling ambidextrous control thereof and/or of a mobile device secured within the device holder attached to the strap assembly.

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A strap assembly for securing a mobile device relative to an arm of a user, the strap assembly comprising:

a strap panel comprising a rachet cable tension adjustment slot;

a ratchet assembly configured to facilitate selective tightening of the strap assembly towards an arm of a user, the rachet assembly comprising:

a ratchet element arranged on the strap panel;

a dynamic cable attachment element disposed within the rachet cable tension adjustment slot and configured to move throughout a range of motion defined along a length of the rachet cable tension adjustment slot; and a ratchet cable extending at least between the ratchet element and the dynamic cable attachment element, the ratchet cable being defined at least in part by a looped cable portion configured for attachment to the dynamic cable attachment element;

wherein the dynamic cable attachment element is configured to be moved along the length of the rachet cable tension adjustment slot in response to one or more forces imparted on the dynamic cable attachment element from the ratchet cable.

2. The strap assembly of claim 1, wherein one or more forces imparted on the dynamic cable attachment element from the ratchet cable are defined at least in part by first tension at a front strap portion of the strap assembly and a second tension at a rear strap portion of the strap assembly.

3. The strap assembly of claim 2, wherein the strap assembly is configured such that a movement of the dynamic cable attachment element to an offset position along the length of the rachet cable tension adjustment slot causes the first tension and the second tension to be at least partially equilibrated.

4. The strap assembly of claim 3, wherein the front strap portion is configured to engage a first arm portion of the arm of the user and the rear strap portion is configured to engage a second arm portion of the user, wherein the first arm portion is defined by a first diameter and the second arm portion is defined by a second diameter that is at least substantially different than the first diameter.

5. The strap assembly of claim 4, wherein the strap assembly is configured such that a position of the dynamic cable attachment element within the ratchet cable tension adjustment slot corresponds at least in part to a difference in the first diameter and the second diameter.

6. The strap assembly of claim 1, wherein the dynamic cable attachment element defines a nominal position within the ratchet cable tension adjustment slot wherein the dynamic cable attachment element is at least substantially aligned with the ratchet element along a vertical axis.

7. The strap assembly of claim 1, wherein the strap panel is configured for engagement with a device holder to facilitate an at least partial attachment of the strap assembly to the device holder.

8. The strap assembly of claim 1, further comprising a band configured to extend around at least a portion of the arm of the user to at least partially secure the strap assembly relative to the arm of the user, wherein the band is attached at a first end to the strap panel.

9. The strap assembly of claim 8, wherein the ratchet cable is further configured to engage at least a portion of the band such that the selective tightening of the strap assembly comprises a second force being imparted on the band from the ratchet cable.

10. The strap assembly of claim 9, wherein the ratchet cable is configured to engage the band at a band cable anchor element fixedly secured to the band.

11. The strap assembly of claim 1, wherein the length of the ratchet cable tension adjustment slot extends between a first slot end and a second slot end, and wherein the ratchet cable tension adjustment slot is defined by a curved profile.

12. The strap assembly of claim 11, wherein the first slot end and the second slot end each define vertical positions that are beneath a corresponding vertical position of a center of the ratchet cable tension adjustment slot such that the curved profile defines a downward-facing arc.

13. The strap assembly of claim 11, wherein the ratchet cable tension adjustment slot is arranged along the strap plate such that the first slot end and the second slot end are equidistant from the ratchet element.

14. The strap assembly of claim 1, wherein a movement of the dynamic cable attachment element from a nominal position defined by the central position along the length of the ratchet cable tension adjustment slot an offset position at a first end of the ratchet cable tension adjustment slot corresponds to an angular movement of the dynamic cable attachment element about the ratchet element through an angle of between 30 degrees and 60 degrees.

15. The strap assembly of claim 1, further comprising a second strap panel positioned on an opposing lateral side of the strap assembly relative to the strap panel and comprising a second rachet cable tension adjustment slot, a second ratchet element arranged on the second strap panel; and a second dynamic cable attachment element disposed within the second rachet cable tension adjustment slot and configured to move throughout a second range of motion defined along the second rachet cable tension adjustment slot.

16. The strap assembly of claim 15, wherein the ratchet cable is further configured to engage the second the dynamic cable attachment element and the second ratchet element, the ratchet cable including a second looped cable portion configured for attachment to the second dynamic cable attachment element.

17. The strap assembly of claim 15, further comprising a second ratchet cable extending between the second ratchet element and the second dynamic cable attachment element, the second ratchet cable being defined at least in part by a second looped cable portion configured for attachment to the second dynamic cable attachment element.

18. The strap assembly of claim 1, wherein the ratchet element is configured to receive a user interaction therewith and initiate the tightening of the strap assembly based at least in part on the user interaction.

19. A wearable mobile device holder configured to secure a mobile device relative to the arm of the user, comprising the strap assembly of claim 1.

20. The wearable mobile device holder of claim 19, further comprising a device holder configured for securing the mobile device therein, wherein the strap panel comprises one or more device holder attachment features configured to facilitate an attachment of the device holder to the strap assembly.

* * * * *